US006592343B1

(12) United States Patent
Pshenychny

(10) Patent No.: US 6,592,343 B1
(45) Date of Patent: Jul. 15, 2003

(54) AIR COMPRESSION DEVICE

(76) Inventor: Valery Pshenychny, 477 Locust St., Galesburg, IL (US) 61401

( * ) Notice: Subject to any disclaimer, the term of this patent is extended or adjusted under 35 U.S.C. 154(b) by 11 days.

(21) Appl. No.: 10/036,221

(22) Filed: Dec. 24, 2001

(51) Int. Cl.[7] ..... F04B 19/00

(52) U.S. Cl. ..... 417/437; 417/453; 417/544; 124/69; 74/579 R

(58) Field of Search ..... 417/437, 453, 417/544; 92/140; 124/69; 74/579 R, 580, 581, 582, 583, 584, 585

(56) References Cited

U.S. PATENT DOCUMENTS 551,157 A * 12/1895 De Clercq ..... 417/549
3,945,304 A * 3/1976 Taylor ..... 92/140
4,048,004 A * 9/1977 Watkins ..... 156/580.1
4,526,520 A * 7/1985 Henderson ..... 417/559
RE32,144 E * 5/1986 Keefer ..... 210/637
4,928,661 A * 5/1990 Bordt et al. ..... 124/69
4,977,817 A * 12/1990 Doman ..... 92/31
5,118,265 A * 6/1992 Bearss ..... 417/534

* cited by examiner

*Primary Examiner*—Charles G. Freay
*Assistant Examiner*—William H. Rodriguez

(57) ABSTRACT

A compact manually operated air compression device for precompressed air guns has been disclosed, wherein two operating levers, positioned on opposite sides of a cylinder, are connected to a piston rod by means of connecting links. Lightweight connection of operating levers to the cylinder provided. Configuration of the device affords adjustment position of the piston in the cylinder.

3 Claims, 4 Drawing Sheets

I - I
18
18a
16
16a
21
13
21a

I
I
19
19a
17
21
21a
16
16a
20
20a
18
18a
11
13
12
14

AIR COMPRESSION DEVICE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The invention relates to a manually operated air compression device.

Known devices of this type generally are employed for pressurizing pre-compressed air guns, wherein at least one operating lever, swingably mounted with respect to the cylinder of compression assembly, connected to the piston via articulated linkage. Traditionally, some elements of this linkage occupy space, additional to the length of the cylinder, increasing length of the compression device.

BRIEF SUMMARY OF THE INVENTION

An object of the present invention is to provide a compact air compression device, wherein piston travel is maximal relatively to the device length.

According to the invention, an improved symmetrical lever assembly is employed with two operating levers pivoted on the cylinder of compression assembly. A first embodiment represents a high-pressure pump, which may be employed for pressurizing containers of so-called pre-charged air guns. Said pump also can be used outside of air guns class, where high air pressure is needed. A second embodiment of the invention is a pre-compressed air pistol, wherein one of operating levers is associated with a pistol frame.

Loading device, valve and trigger mechanism arrangements are out of the scope of this invention, and are not disclosed hereafter.

DETAILED DESCRIPTION OF THE INVENTION

Figures 1, 2:
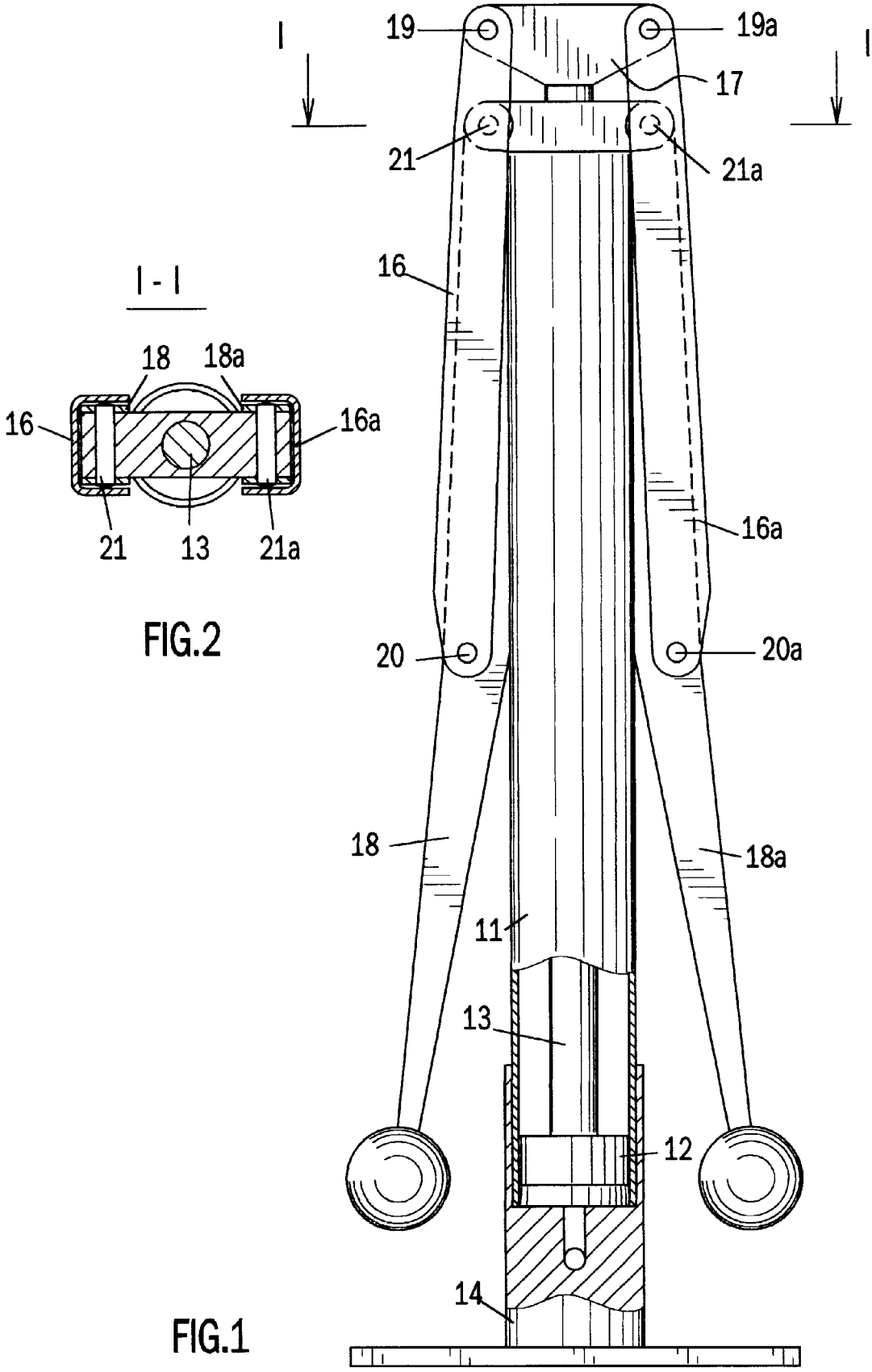
FIG. 1 is a side view of the first embodiment of the invention in closed position.
FIG. 2 is a cross-section of the first embodiment in plane I—I of FIG. 1.
Figure 3:
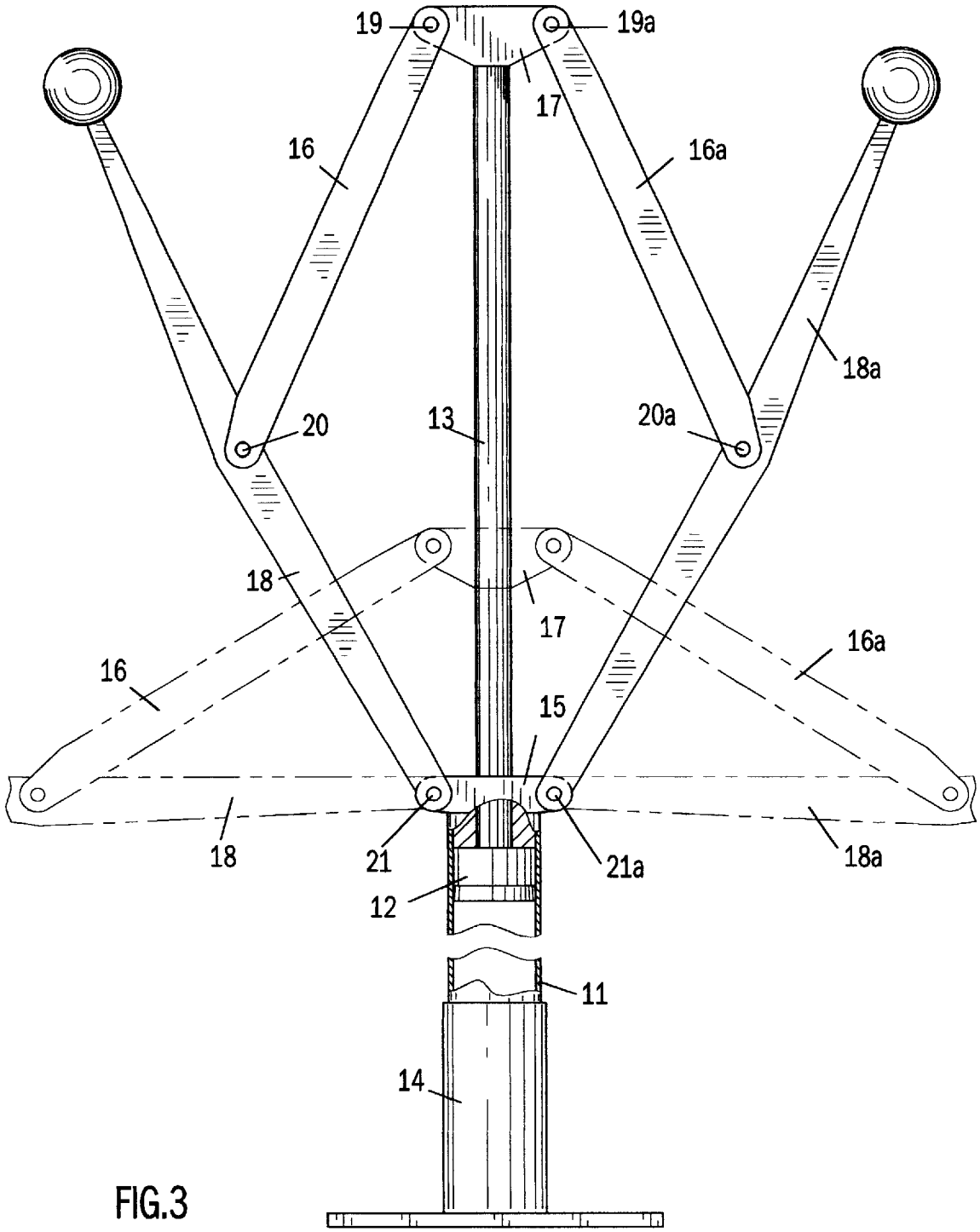
FIG. 3 is a side view of the first embodiment in open and mid-closed position.

Referring to FIGS. 1, 2 and 3, the first embodiment of the invention has a cylinder 11, a lower end of which is inserted in a base block 14. Movable in the cylinder 11 a piston 12 rigidly attached to a lower end of a piston rod 13. Secured in an upper end of the cylinder 11 a guide block 15 serves as a guide for the piston rod 13. An upper portion of the guide block 15 formed as a bracket for pivot connections 21 and 21*a* of operating levers 18 and 18*a* respectively.

An upper end of the piston rod 13 is provided with an anchor 17. A link 16 is connected with one of its ends to the operating lever 18 by a pivot 20. The other end of the link 16 is pivoted to the anchor 17 at 19. A link 16*a* connects the lever 18*a* by a pivot 20*a* to the anchor 17 with a pivot 19*a*.

Operating levers 18 and 18*a*, links 16 and 16*a* preferably are U-shaped in cross-section. Links are wider than levers so that portion of the lever can come inside of the link when they fold along the cylinder.

Preferably, all construction is symmetrical with respect to the cylinder axis.

Shown additionally (FIG. 3) by phantom lines position of the device intermediate open and closed positions illustrates an advantage represented by the device to the user in overcoming hyperbolically increasing air pressure through a compression stroke. As seen, initial rotation of operating levers at approximately 60-degree angle causes excursion of the piston (piston rod) at ¾ of entire travel; last ¼ of the piston travel is performed by further rotation of operating levers at almost 90 degrees. This way forces exerted on the operating levers being low through the stroke.

Length relationships of elements in present embodiment are taken for instance. Practically, dimensioning of the device can be done only as based on or limited by following requirements:

air displacement,
compression rate or air pressure,
swinging angle of operating levers,
forces on operating levers,
total weight and
total length, therefore cannot be disclosed here.

Present air compression device can be integrated in different types of pre-compressed air guns. In this case, parts of the device may be associated with parts of the gun and have different configuration.

An air pistol, wherein one of the operating levers associated with a pistol frame, represents the second embodiment of the invention.

Figure 4:
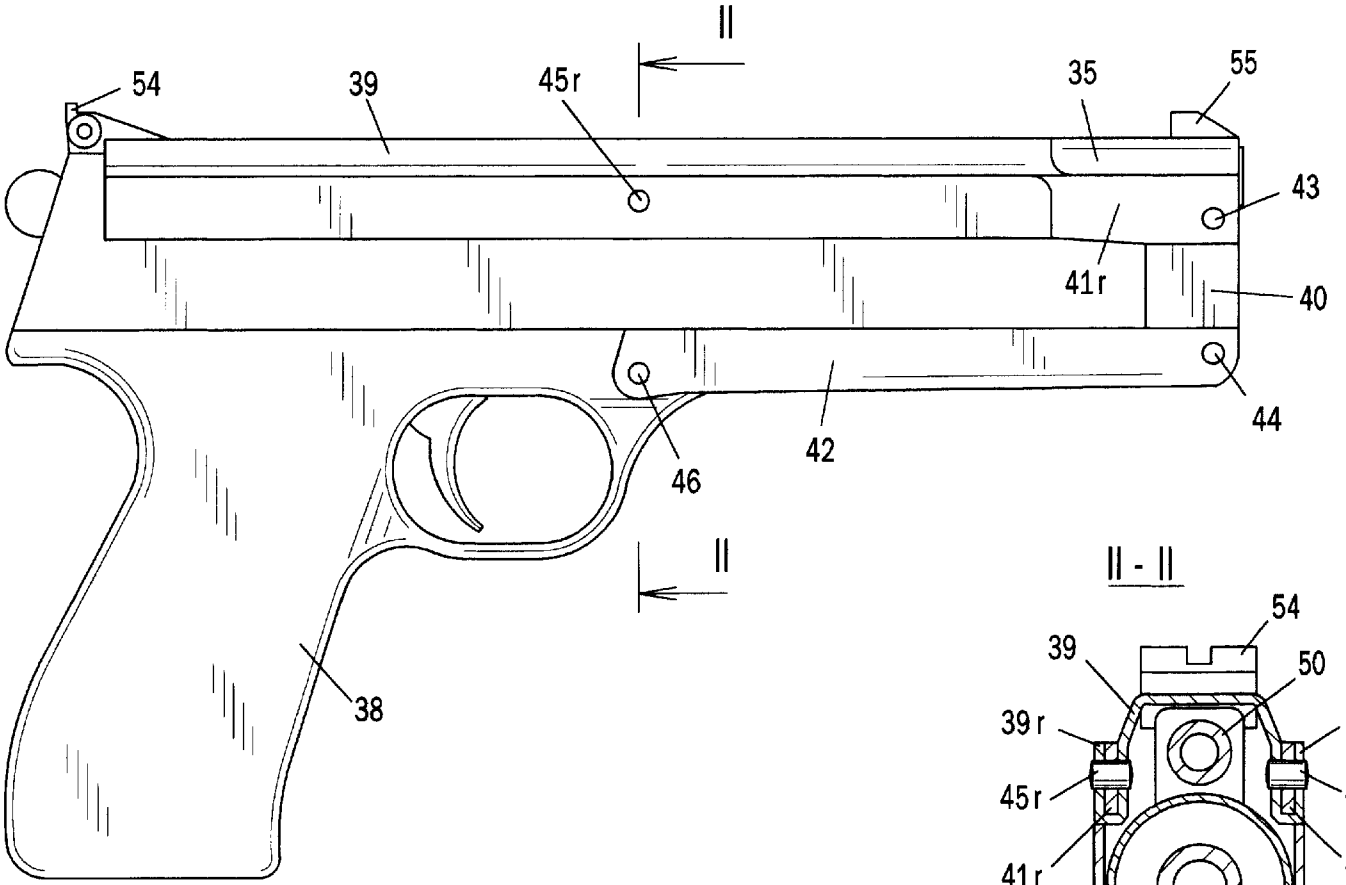
FIGS. 4 and 6 are side views of the second embodiment of the invention in closed and open position respectively.
Figure 5:
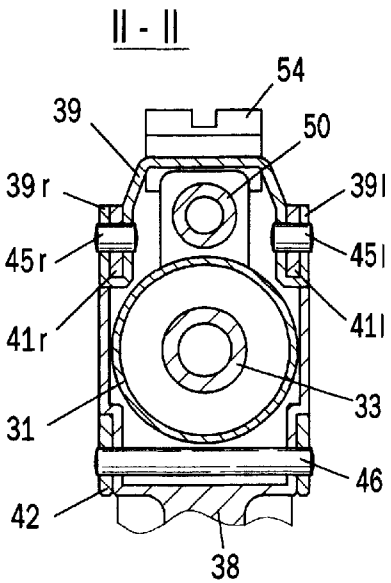
FIG. 5 is a cross-section of the second embodiment in plane II—II of FIG. 4.
Figures 6, 7, 8, 9:
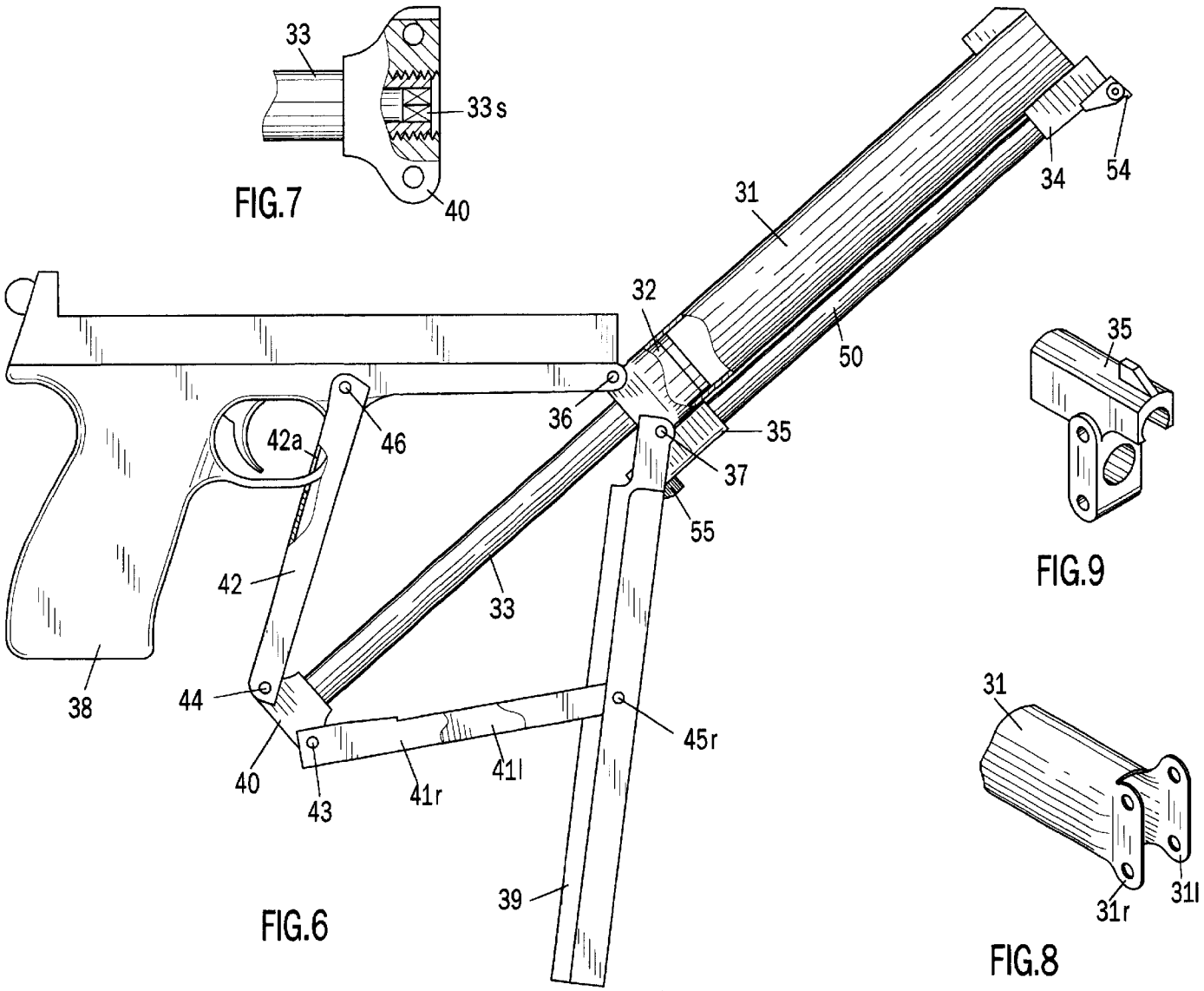
FIG. 7 is a drawing of the connection between the piston rod and the anchor of the second embodiment.
FIG. 8 is an isometric view of the front portion of the cylinder of the second embodiment.
FIG. 9 is an isometric view of the guide block of the second embodiment.

Referring to FIGS. 4, 5 and 6, the second embodiment has a cylinder 31 mounted on a pistol frame 38 by a pivot 36. A breech block 34 is secured in a rear end of the cylinder 31. A guide block 35 mounted in a front end of the cylinder 31. Upper portions of said blocks 34 and 35 serve as brackets for a barrel 50, and also for a rear sight 54 and a front sight 55 respectively.

An operating lever 39 swingably mounted on the cylinder 31 by a pivot 37. A pair of links 41*r* and 41*l* is connected to the operating lever 39 with pivots 45*r* and 45*l*. As seen, (FIG. 5) the operating lever 39 is formed with brackets 39*r* and 39*l* serving as supports for pivots 45*r* and 45*l*. Pivoted on the pistol frame 38 at 46, U-shapped in cross-section link 42 may have a slot 42*a* for a trigger guard in open position of the pistol.

A front end of a piston rod 33 is provided with an anchor 40 for pivot connections of the link 42 at 44 and pair of links 41*r* and 41*l* at 43.

Thread connection between the anchor 40 and the piston rod 33 can be used for adjustment of the piston position in the cylinder. Referring to FIG. 7, the front end of the piston rod 33 is formed with a polygonal socket 33*s* so that piston rod 33 with the piston 32 can be rotated about their axis with a wrench. This feature allows loosening up length tolerances of parts of compression assembly and in certain limits adjustment of compression rate without disassembly of the device.

Referring to FIG. 8, the front end of the air cylinder 31 is formed with two flat mounting brackets 31*r* and 31*l* so that guide block 35 (FIG. 9) can be secured between said brackets with pivots 36 and 37. In comparison with the first embodiment, this type of connection allows saving some space to increase piston travel for given length of the cylinder. The guide block 35 can be fabricated out of lightweight synthetic material, since it is not loaded by air pressure.

Although apparent to those skilled in art, some advantages of present air pistol should be mentioned here.

First, unusually big swinging angle of the operating lever helps to achieve high air pressure with low force even in very compact pistols.

Second, compressed air force is equally divided between two articulated linkages, positioned symmetrically with respect to the cylinder. This advantage positively affects pistol accuracy and gives a good opportunity in utilizing lightweight materials for lever assembly and pistol frame.

Third, great air displacement and high pressure afford utilizing big caliber projectiles with sufficient velocity.

I claim:

1. An air compression device, comprising:

a cylinder having a first end and a second end;

a piston movable in the cylinder from the first end toward the second end thereof for compressing an air therein;

a piston rod a first end of which is rigidly attached to the piston and a second end of which piston rod is extending from the fist end of the cylinder; and a lever assembly, comprising two operating levers foldable along the cylinder length on the opposite sides thereof; said operating levers with their first ends are pivoted with respect to the cylinder, each of which operating levers at a point, intermediate the first and the second end thereof, is connected to the second end of the piston rod by means of at least one link.

2. The air compression device of claim 1, wherein the first end of the cylinder is formed with two mounting brackets for pivot connections of the operating levers to the cylinder.

3. The air compression device of claim 1, wherein the links are connected to the piston rod via an anchor, and a thread connection between the piston rod and the anchor affords adjustment position of the piston in the cylinder.

* * * * *